US009468972B2

(12) United States Patent
Wang

(10) Patent No.: US 9,468,972 B2
(45) **Date of Patent: *Oct. 18, 2016**

(54) METHOD OF MAKING ND—FE—B SINTERED MAGNETS WITH REDUCED DYSPROSIUM OR TERBIUM

(71) Applicant: GM Global Technology Operations LLC, Detroit, MI (US)

(72) Inventor: Yucong Wang, West Bloomfield, MI (US)

(73) Assignee: GM Global Technology Operations, LLC, Detroit, MI (US)

( * ) Notice: Subject to any disclaimer, the term of this patent is extended or adjusted under 35 U.S.C. 154(b) by 758 days.

This patent is subject to a terminal disclaimer.

(21) Appl. No.: 13/628,149

(22) Filed: Sep. 27, 2012

(65) Prior Publication Data

US 2013/0084204 A1 Apr. 4, 2013

Related U.S. Application Data

(60) Provisional application No. 61/617,956, filed on Mar. 30, 2012, provisional application No. 61/541,290, filed on Sep. 30, 2011.

(51) Int. Cl.

| | |
|---|---|
| ***B22F 1/02*** | (2006.01) |
| ***C22C 33/02*** | (2006.01) |
| ***H01F 41/02*** | (2006.01) |

(52) U.S. Cl.

CPC ..... *B22F 1/025* (2013.01); *C22C 33/0207* (2013.01); *C22C 33/0278* (2013.01); *H01F 41/0293* (2013.01)

(58) Field of Classification Search

CPC C22C 33/0207; C22C 33/0278; B22F 1/025

USPC ..... 148/100

See application file for complete search history.

(56) References Cited

U.S. PATENT DOCUMENTS

| | | | | |
|---|---|---|---|---|
| 7,632,360 | B2 * | 12/2009 | Mori et al. | 148/302 |
| 8,187,392 | B2 * | 5/2012 | Yoshimura et al. | 148/122 |
| 8,480,815 | B2 * | 7/2013 | Wang | 148/101 |
| 2011/0250087 | A1 * | 10/2011 | Sagawa | C22C 38/005 419/5 |

(Continued)

FOREIGN PATENT DOCUMENTS

| | | |
|---|---|---|
| CN | 101640087 A | 2/2010 |
| CN | 101978441 A | 2/2011 |

OTHER PUBLICATIONS

C.S. Herget, "Metallurgical Methods for the Production of Rare Earth-Transition Metal Permanent Magnet Materials", V. 42, pp. 438-444, 1987, Metal, Poed. Rep.

(Continued)

*Primary Examiner* — Jie Yang

(57) ABSTRACT

A method of making a permanent magnet and a permanent magnet. The method includes providing combining a core material and a surface material so that the surface concentration of dysprosium, terbium, or both in the surface material is high while simultaneously keeping the bulk concentration of dysprosium, terbium, or both low. From this, the magnet has a non-uniform distribution of dysprosium, terbium or both. Varying approaches to preparing the combined core and surface materials may be used to ensure that the surface powder effectively wraps around the core powder as a way to achieve the high surface concentration and low bulk concentration. In one form, the core material may be made from a neodymium-iron-boron permanent magnet precursor material.

19 Claims, 3 Drawing Sheets

(56) References Cited

U.S. PATENT DOCUMENTS

| | | | | |
|---|---|---|---|---|
| 2012/0137829 | A1* | 6/2012 | Harris et al. | 75/363 |
| 2012/0182102 | A1 | 7/2012 | Wang | |

OTHER PUBLICATIONS

D. Plusa, et al., "Domain Structure and Domain-Wall Energy in Polycrystalline R2Fe14B Compounds", V. 133, pp. 231-243, 1987, Journal of the Less-Common Metals.

W. Rodewald, "Magnetization and Aging of Sintered Nd—Fe—B Magnets", V. 111, pp. 77-81, 1985, Journal of the Less-Common Metals.

Machida et al., Improved Magnetic Properties of Small-Sized Magnets and Their Application for DC Brush-less Micro-Motors, Coll, Abstr. Magn. Soc. Jpn. 142, pp. 25-30, 2005.

* cited by examiner

METHOD OF MAKING ND—FE—B SINTERED MAGNETS WITH REDUCED DYSPROSIUM OR TERBIUM

This application claims the benefit of U.S. Provisional Application Ser. No. 61/541,290, filed Sep. 30, 2011 and U.S. Provisional Application Ser. No. 61/617,956, filed Mar. 30, 2012.

BACKGROUND OF THE INVENTION

The present invention relates generally to electric motors and their manufacture, and more particularly to methods for forming permanent magnets that use rare earth (RE) additives for improved power density of electric motors.

Permanent magnets are used in a variety of devices, including traction electric motors for hybrid and electric vehicles, as well as wind turbines, air conditioning units and other applications where combinations of small volumes and high power densities may be beneficial. Sintered neodymium-iron-boron (Nd—Fe—B) permanent magnets have very good magnetic properties at low temperatures. However, due to the low Curie temperature of the $Nd_2Fe_{14}B$ phase in such magnets, the magnetic remanence and intrinsic coercivity decrease rapidly with increased temperature. There are two common approaches to improving thermal stability and magnetic properties at high temperatures. One is to raise the Curie temperature by adding Cobalt (Co), which is completely soluble in the $Nd_2Fe_{14}B$ phase. However, the coercivity of Nd—Fe—B magnets with Co decreases, possibly because of the nucleation sites for reverse domains. The second approach is to add heavy RE elements such as dysprosium (Dy) or terbium (Tb). It is known that the substitution of Dy for Nd or Fe in Nd—Fe—B magnets results in increases of the anisotropic field and the intrinsic coercivity and a decrease of the saturation magnetization. See, for example, C. S. Herget, *Metal, Poed. Rep.* V. 42, P. 438 (1987); W. Rodewald, *J. Less-Common Met.*, V111, P77 (1985); and D. Plusa, J. J. Wystocki, *Less-Common Met.* V. 133, P. 231 (1987). It is a common practice to add the heavy RE metals such as Dy or Tb into the mixed metals before melting and alloying.

However, Dy and Tb are very rare and expensive materials. Heavy REs contain only about 2-7 percent Dy, and only a small fraction of the RE mines in the world contain heavy REs. The price of Dy has increased sharply in recent times. Tb, which is needed if higher magnetic properties are required than Dy can provide, is even more expensive than Dy. Furthermore, these metals may be difficult to work with in their relatively pure form, where for example pure Dy is too soft to form into a powder, and is also easily oxidized. While hydrides of Dy can be used to embrittle the material (and therefore make the formation of powder possible), such materials can adversely impact diffusion characteristics and the ability of the material to work at lower temperatures, which in turn may be incompatible with subsequent sintering or related material consolidation efforts. For example, the rapid diffusion of hydrided Dy means that the normally high temperatures associated with sintering (for example, about 1000° C. or more) could not be used for material consolidation, as at this temperature, the extent of the Dy diffusion—and concomitant need for more material to provide ample coverage—would be too great.

Typical magnets for traction electric motors in hybrid cars and trucks contain between about 6 and 10 weight percent Dy to meet the required magnetic properties, while other applications (such as the aforementioned wind turbines and air conditioners, as well as other vehicular configurations (such as motorcycles that may not have as high of an operating temperature environment as their car and truck counterparts) may have lower Dy needs. Assuming the weight of permanent magnet pieces is about 1-1.5 kg per electric motor, and a yield of the machined pieces of typically about 55-65 percent, 2-3 kg of permanent magnets per motor would be required. Moreover, because other industries compete with permanent magnets for limited Dy resources (thereby exacerbating already high costs associated with such materials), reducing the Dy usage in permanent magnets would have a very significant cost impact, as it would for Tb.

Nd—Fe—B permanent magnets can be produced using a powder metallurgy process, which involves making powders with desired chemical composition. A typical powder metallurgy process includes weighing, pressing under a magnetic field, sintering, aging (e.g., about 5 to 30 hrs, at about 500° C. to 1100° C., in vacuum) and machining in order to produce magnet pieces. Additional surface treatments involving phosphating, electroless nickel plating, epoxy coating or the like may also be used.

The ideal microstructure for sintered Nd—Fe—B magnets is $Fe_{14}Nd_2B$ grains perfectly isolated by the nonferromagnetic Nd-rich phase made up of a eutectic matrix of mainly Nd plus some $Fe_4Nd_{1.1}B_4$ and Fe—Nd phases stabilized by impurities. The addition of Dy or Tb leads to the formation of quite different ternary intergranular phases based on Fe, Nd and Dy or Tb. These phases are located in the grain boundary region and at the surface of the $Fe_{14}Nd_2B$ grains.

The microstructures of Nd—Fe—B sintered magnets have been extensively investigated in order to improve the magnetic properties of such magnets composed mainly of the hard-magnetic $Nd_2Fe_{14}B$ phase and the nonmagnetic Nd-rich phase. The coercivity is known to be greatly influenced by the morphology of the boundary phases between $Nd_2Fe_{14}B$ grains. The magnetic properties of the Nd—Fe—B sintered magnets are degraded when the magnet size is decreased because the machined surface causes nucleation of magnetic reversed domains. Likewise, in their work entitled *Improved Magnetic Properties of Small-Sized Magnets and Their Application for DC Brush-less Micro-Motors*, Coll. Abstr. Magn. Soc. Jpn. 142 (2005), 25-30), Machida et al. found that the degraded coercivity of small-sized Nd—Fe—B sintered magnets can be improved by surface treating the formed magnet with Dy and Tb-metal vapor sorption so that there is a uniformly distributed coating of Dy or Tb on the outside of the formed magnet. While such approaches are helpful in improving the properties of magnets that have been treated with Dy or Tb, they do so at great expense by utilizing too much of these precious materials.

SUMMARY OF THE INVENTION

One aspect of the invention is a method of making a permanent magnet. In one embodiment, the method includes combining a first material (which may be in the form of a core powder) containing Nd, Fe and B with a second material (which may be in the form of a surface powder or flake) containing one or both of Dy or Tb in metallic alloy form so that a coated, composite-like material is formed with an inhomogeneous (or non-uniform) distribution of the Dy or Tb that makes up the second material; this ensures the presence of a surface concentration of Dy, Tb or both that is in excess of their bulk concentration while keeping the overall usage low. Within the present context, a non-uniform or inhomogeneous distribution refers to that where the second material is distributed or concentrated at discrete locations of the first material—such as at the interfaces or grain boundaries or other locations on a surface—with little or none (such as by diffusion, chemical combing or the like) inside the particles that make up the first material.

In one form, the Dy- or Tb-containing alloy may be in small powder form, while in another, the material may be in a larger flake-based form; details associated with these size differences are discussed at more length below. Regardless of the form, they may be used for blending, mixing and mechanically coating to produce the composite-like material. Powder and flake-shaped powder can be made by using atomization (molten metal meeting high pressure inert gas (such as argon) to form particles) or by slip casting followed by hydrogen decrepitation and dehydrogenation.

Significantly, a magnetic material produced according to the present invention may be sintered in such a way as to keep diffusion low and thereby preserve the desired inhomogeneous content of one or both of Dy and Tb around the grain boundary areas (also referred to herein as grain boundary surface). In one form, the permanent magnet has a grain boundary surface concentration of between about 3 weight percent and about 40 weight percent of Dy, Tb or both.

The present invention employs changes in temperature, time, spatial configuration and chemistry in order to change the diffusion or related transport properties of Dy and Tb, as well as various other elements such as Nd, Pr, Gallium (Ga), B, Fe, Co, copper (Cu) or the like. In one particular form, mechanical wrapping of the coating material around the coated material may take place by adjusting these parameters, where more complete wrapping can be achieved with higher energy levels, although the wrapping does not need to be complete in order to demonstrate improved performance. In such case, partial wrapping may also be acceptable in certain circumstances due to the diffusion of one or more of the above elements during sintering. By controlling the milling and mixing kinetics, new and different material phases may be formed. Additional improvements may occur as a result of adding some elements separately (either in individual form or as part of a binary or ternary alloy) during the process. Such improvements specifically help promote the selective formation of new phases or phase with different elemental content such as mentioned above. These phases may include the eutectic phases around grain boundaries with one or more of the various elements mentioned above, such as Nd- and Dy-rich triple-junction phases. These phases (which, from the phase diagrams, are eutectic phases with multiple elements) may play important roles in improving (i.e., increasing) coercivity ($H_{cJ}$) or other magnetic properties. From their morphology, they can be called triple- (or multiple-) junction phases because they are located around grain boundaries, especially around the junction regions where three or (multiple) grains meet.

Another aspect of the present invention involves a method of making an Nd-based permanent magnet with an inhomogeneous dispersion of at least one of Dy or Tb by mechanically milling an Nd—Fe—B-containing powder-based material and a flake-based material containing at least one of Dy and Tb such that the powder-based material is substantially coated with a layer of the flake-based material. After the milling, excess parts of the flake-based material that didn't coat the coated powder-based material are removed by screening, after which the coated composite-like material is formed into a predetermined shape under a magnetic field for powder alignment. This shaped part is then sintered such that the permanent magnet is formed where the flake-based material used to coat the underlying powder-based material is distributed in a non-uniform way. In one form, such non-uniformity is through preferential accumulation at the grain boundaries of the underlying powder-based material, or by eutectic phase formation during sintering.

Still another aspect of the present invention involves a method of making an Nd-based permanent magnet with an inhomogeneous dispersion of at least one of Dy or Tb. The method includes mechanically milling a first powder-based material containing Nd—Fe—B and a second powder-based material containing at least one of Dy and Tb such that the first powder-based material is substantially coated with a layer of the second powder-based material. This coated powder is then formed into a predetermined shape under a magnetic field and then sintered such that the permanent magnet is formed with the second powder-based material being is distributed in a non-uniform way on a surface of the first powder-based material. As before, such non-uniformity may be through preferential accumulation at the grain boundaries of the underlying powder-based material, or by eutectic phase formation.

Yet another aspect of the invention is a permanent magnet. In one embodiment, the permanent magnet is Nd—Fe—B-based with a bulk concentration of Dy, Tb or both that is significantly reduced relative to a conventionally-formed RE-enhanced permanent magnet. Thus, for an automotive traction motor used for a car or truck (where as discussed above the bulk concentrations of a conventional Dy- or Tb-enhanced Nd—Fe—B magnet may be between about 6 and 10 weight percent), the permanent magnet of the present invention may exhibit significant reductions of 50 percent or more. Thus, in one form for traction motors, the bulk Dy or Tb may exist in a range of about 0.3 to about 5 weight percent in a non-uniform (i.e., surface-dominated) distribution of such Dy or Tb such that the magnetic properties mimic those of Dy or Tb-treated magnets with much larger bulk concentrations. Likewise, in situations where the bulk Dy or Tb usage may be lower (for example, in wind turbine applications that may have between about 3 and 4 weight percent), comparable reductions are similarly possible.

BRIEF DESCRIPTION OF THE DRAWINGS

The following detailed description of the present invention can be best understood when read in conjunction with the following drawings, where like structure is indicated with like reference numerals and in which.

DETAILED DESCRIPTION OF THE INVENTION

Figure 1:
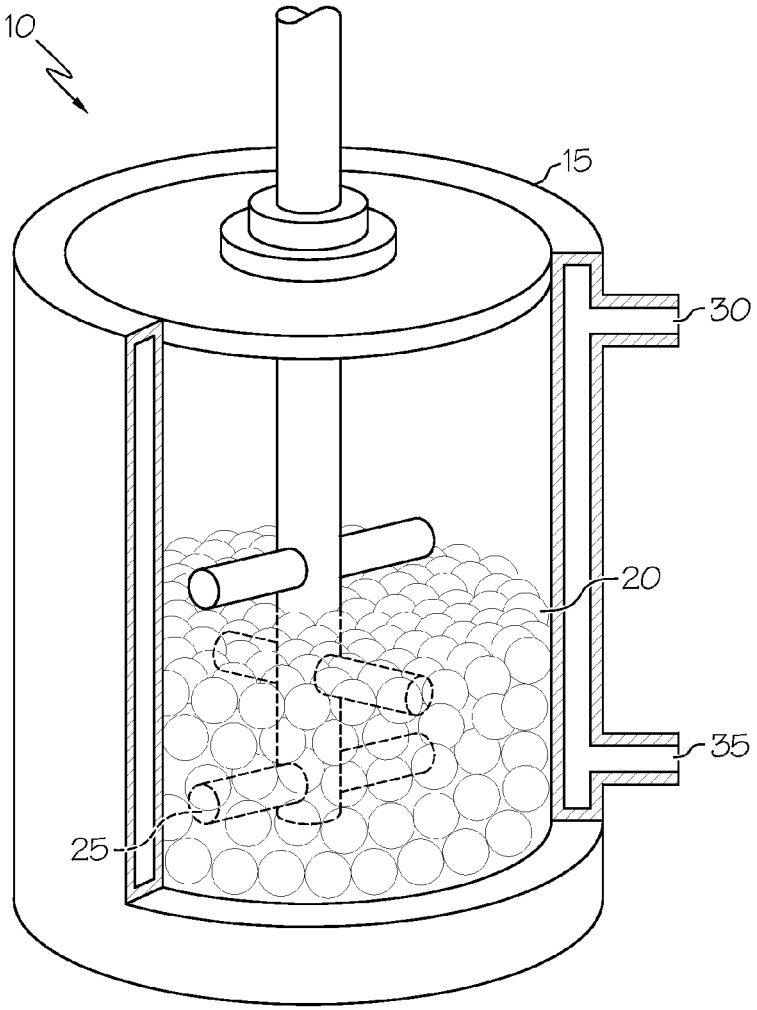
FIG. 1 is a schematic of a mechanical mill that may be used to mix the various ingredients used to produce rare earth-enhanced magnet materials.

U.S. application Ser. No. 13/007,203, filed Jan. 14, 2011, entitled Method Of Making Nd—Fe—B Sintered Magnets With Dy Or Tb (hereinafter the '203 application), which is assigned to the assignee of the present invention and is incorporated herein in its entirety by reference, describes magnets and three methods of making them that use much less Dy or Tb than those made using the conventional methods while obtaining similar magnetic properties. Of the three powder coating methods discussed in the '203 application, the present inventor has discovered ways to improve one of them (mechanical milling, also referred to herein as mechanical alloying); such improvements are the subject of the present invention.

Dy or Tb (or their alloys) coated Nd—Fe—B powders are used to make the magnet, which results in a microscopically non-uniform distribution of Dy or Tb in the magnet; such features may be seen and measured using a scanning electron microscope with a microprobe. The inventor believes that by the present invention, the amount of Dy and/or Tb can be reduced by (depending on the application to which the magnets are placed) about 20 percent (by weight) or more compared to conventional processes, or about 30 percent or more, or about 40 percent or more, or about 50 percent or more, or about 60 percent or more, or about 70 percent or more, or about 80 percent or more or about 90 percent or more. The amount of savings depends on relative amount of surface powder to core powder and the Dy or Te concentration in the surface powder, as well as the sintering schedule (which affects diffusion of Dy or Tb into the bulk of the core powder from grain surface).

A sintering schedule useful for the present invention used in a traction motor application may include the following parameters. First, a preferred sintering temperature range is between about 850° C. and 1100° C., with a more preferred range between about 950° C. and 1050° C. A preferred heating rate is between about 2° C. and 6° C. per minute, with a more preferred range of about 5° C. per minute. A preferred sintering time is about 1 to 10 hours with a conventional sintering furnace, and a more preferred time of between about 3 and 7 hours. A heat treatment after sintering is also preferred; in such case, a two-stage heat treatment is preferred, where a first stage takes place at a temperature of over 800° C. for about 2 to 5 hours, with a more particular time being about 3 hours, after which a second stage involves heating to a temperature of about 500° C. for about 2 to 5 hours (with a more preferred time of about 3 hours) under an argon atmosphere. The required total time is between about 11 hours and 20 hours, including heat up and cool down between stages, where such cool down may be achieved through the forced introducing of argon.

The process associated with the present invention involves coating the Nd—Fe—B based powder used to make sintered Nd—Fe—B permanent magnets with Dy or Tb metals or alloys via mixing and mechanical milling. Preferably, the addition of these (or related) elements to improve the magnetic properties should desirably fulfill the following conditions: (1) the intermetallic phase should be nonferromagnetic to separate the ferromagnetic grains; (2) the intermetallic phase should have a lower melting point than the $Fe_{14}Nd_2B$ phase to produce a dense material via liquid phase sintering; and (3) the elements should have a low solubility in $Nd_2Fe_{14}B$ to keep good magnetic properties. In one exemplary form, iron-based material containing between about 15 and 80 weight percent Dy or Tb is milled or mechanically alloyed with Nd—Fe—B based powder to create new composite-like powders with Dy- or Tb-enriched surfaces. Because pure Dy is very soft and has a tendency to oxidize rather easily, alloying it can help improve its resistance to oxidation, as well as help to embrittle it to help convert it into powder form.

The present invention is directed toward variations of the mechanical milling method discussed in the '203 application by addressing how to make an alloy powder wrap around Nd—Fe—B powder in what is referred to herein as a "wrap-around" magnet manufacturing process. In other words, the wrap-around is achieved through the mechanical milling process by having a coating-like surface form on the particles that make up the Nd—Fe—B powder such that solid diffusion (or even liquid sintering) takes place at the surface to create new grains with Dy- or Tb-enriched surfaces during sintering. In the present context, solid diffusion includes atomic (such as Dy) diffusion in solids, whereas liquid sintering may involve part of the materials being melted or otherwise softened during sintering; this latter approach promotes liquid diffusion. By the present method, the inventor believes that Dy or Tb surface concentration of the powders can be as high as about 5 to about 50 weight percent while still preserving a very low (for example, between roughly 0.3 and 5 weight percent or less in traction motor applications) bulk Dy or Tb concentration. The mechanical milling of the present invention involves two different types of Dy- or Tb-containing powders: either (a) very small powder (i.e., that which is smaller than that of the underlying Nd—Fe—B core powder) or (b) a flake-like powder that is much larger than that of the underlying Nd—Fe—B core powder. In this second scenario, some of the Dy- or Tb-containing flakes are left-over after the coating; as will be discussed below, this residual may be removed such that it may be used again. In particular, the method of the present invention involves first making various Dy- or Tb-containing alloys, and then converting them into small powder or larger flake form via melting, slip casting, atomizing or the like so that they can coat the base or core Nd—Fe—B powders in the desired non-uniform way.

Specific elements of the process disclosed herein preferably include (1) using a high energy mill to favor plastic deformation required for cold welding—which involves a solid-state process in which joining takes place through diffusion without high fusion or heating at the interface—as well as to reduce the process times; (2) using a mixture of elemental and master alloy powders (the latter to reduce the activity of the element, since it is known that the activity in an alloy or a compound could be orders of magnitude less than in a pure metal); and (3) limited use of surface-active agents to keep contamination of the powder to minimum, as well as to help make small powder particles effectively wrap around big ones, with a constant interplay between welding and fracturing to yield a powder mixture with a refined internal structure. In the present context, welding includes local material melting or softening and subsequent sticking together, while fracturing may happen with high pressure during a pressing step.

Referring first to FIG. 1, a milling machine 10 (also referred to herein as a ball mill) includes a rotating cylindrical drum 15 with an aspect ratio of up to three diameters in length such that a charge of tumbling or cascading steel balls 20, rods or related agitating elements can by their falling and lift due to drum 15 rotation grind one or more materials (not shown) placed therein into a finer form. In one form, the balls 20 may occupy one third to half of the total internal volume of the drum 15. The drum 15 may be made from stainless steel, and may additionally be coated on the inside with alumina, silicon carbide, silicon nitride or the like. Likewise, additional arrangements for cooling, heating or the like may also be employed, as discussed in more detail below. Unlike the ball mill depicted in the '203 application, the present ball mill 10 incorporates the two types of surface particle sizes (corresponding to the aforementioned surface and core powders), as well as two different ways of how surface particles can be made, along with agents that may be used to promote surface alloying. Furthermore, the present disclosure places significant emphasis on surface particle morphology that was not considered in the '203 application. In particular, the surface powder should be more irregularly shaped (i.e., not round) to promote large surface areas and concomitant increased ability to be alloyed. A solvent or carrier may be employed to speed up the mechanical alloying and coating process to improve process effectiveness by helping to reduce the interfacing energy between the surfaces of both powders that in turn increases the uniform wrapping or distribution of the surface powder, as well as to avoid surface powder clustering. The solvent or carrier can be organic or inorganic chemicals, such as alcohol, chlorinated solvents, or commercially-available industrial solvent, as well as solid lubricant such as boron nitride powder, molybdenum disulfide ($MbS_2$) powder or the like. Preferably, the solvent is removed from the powder after the processing.

In situations where the core powder of Nd—Fe—B is to be coated with an Fe-based Dy or Tb flaked material, the first step involves weighing the Dy- or Tb-containing flakes, and then mixing them with the Nd—Fe—B powder through the combined action of drum 15, balls 20 and the movement of impeller 25. A cooling jacket formed around the ball mill 10 may be used to control the milling temperature, where a heating or cooling fluid (not shown) may be circulated through the jacket via inlet 30 and outlet 35. The process temperature is preferably between about room temperature and about 200° C., in either an evacuated or argon/nitrogen inerted atmosphere. In one form, the balls 20 making up the milling medium can be stainless steel or ceramic with different diameters to produce dynamic (i.e., varied) impact energy. In one form, the balls 20 used as a milling medium may be made from different sizes, including those that are relatively large (20A), medium (20B) and small (20C). For example, they may have three separate sizes of 1 mm, 5 mm and 10 mm, although additional sizes are also possible. The weight ratio of three balls 20 can vary, such as 1:1:1, 1:1:2, 1:2:3, 2:1:3, or the like. Adding more milling medium, as well as using a larger number of the larger-size balls 20, provide more dynamic impact energy. At the end of the milling, a layer of Dy or Tb-containing coating is formed on the Nd—Fe—B powder by the wraparound action of the larger, softer Dy or Tb-containing flakes; in one form, the thickness is between about 0.1 to 5 microns, and more particularly between about 0.2 to 3 microns, although other coating thickness possibilities (for example, up to 10 microns (in some configurations) and even 100 microns (in others) may also be used, depending on the application. As a general rule, while the thickness of the flakes is not critical, the size of the particles of the underlying core material tend to be much more sensitive to size, where by way of example, diameters (or diameter equivalents) of less than 1 to 2 microns is considered to be too fine for coating applications (and may additionally suffer from altered magnetic properties), while diameters or their equivalents of over about 30 microns tends to exhibit diminished magnetic properties.

Once the flake-like particles have formed a coating on the core powder, the remaining flake-like particles are then screened out for future reuse, while the coated Nd—Fe—B powder is subsequently subjected to forming and sintering. Advantageously, while the resulting Dy or Tb surface concentration is high (for example, between about 5 and 50 weight percent, as mentioned above), the bulk Dy or Tb concentration is low (again, less than 5 percent by weight for many automotive traction motor applications), thereby reducing the usage of Dy or Tb in making permanent magnets while still delivering high temperature magnetic properties. This sensitivity of the core powder to its size is relevant whether the coating material is in flake-based form or in the powder-like form, as will be discussed next.

In situations where the core powder of Nd—Fe—B is to be coated with an Fe-based Dy or Tb powder material, the starting powder size of the second (i.e., coating) powder is preferably smaller than that of Nd—Fe—B first (i.e., coated) powder that may include heavy rare earth elements such as Dy and Tb or other elements in insignificant (for example, less than 3 to 5 percent by weight) amounts. This second powder can be made by two methods.

One method, known as the hydride and de-hydride process, is the same as that for making the Nd—Fe—B powder, where the alloy is made by vacuum induction melting, and the molten alloy is slip cast onto a rotating water cooled copper alloy drum to form thin pieces (e.g., 0.2 to 0.5 mm thick, and about 5 to 100 mm in length and width). The process is carried out in vacuum (e.g., about $10^{-5}$ to $10^{-6}$ atmosphere) or argon atmosphere to prevent oxidation or contamination. The thin pieces in the sealed steel container are transported to a hydride cracking machine to make the powder where the $H_2$ pressure is about 15 psi and the duration is about 5 to about 18 hours. After the pieces crack to powder, or very small pieces, hydrogen gas is removed at a temperature of about 300° C. to about 400° C., typically about 350° C. The duration is about 5 to about 25 hours. The powder is then further hammer milled to a smaller size in a hammer milling machine under inert gas ($N_2$ or Ar at about 15 to about 30 psi) or nitrogen (or argon) milled in a separate gas milling machine (not shown). Regardless of the form of the mill, it is preferable that the contact surface of the machine is made of stainless steel or tungsten alloy to prevent contamination. The processed powder is stored in a barrel under about 15 to about 30 psi $N_2$). A grinder and/or miller are used to make a much finer powder in the desired size range, and the powder may be screened for such desirable ranges. All the operations are performed under inert atmosphere (for example, about 25 psi $N_2$) to prevent oxidation and contamination.

The other method to make the Fe—Dy type powder is using an atomizing process. After vacuum melting, the molten metal or the melted ingot can be atomized to a fine powder with $N_2$ or Ar. The powder size can be further reduced using milling, such as through milling machine 10 as described above.

Figure 2A:
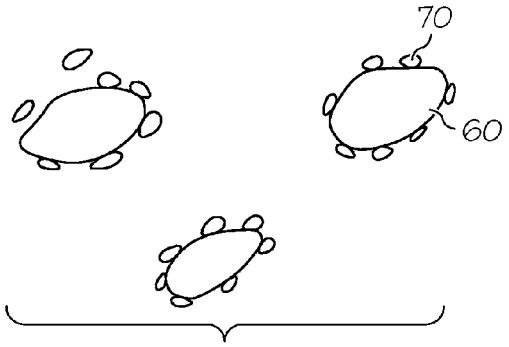
FIG. 2A is a schematic of particles of a surface powder and a core powder after mixing and coating to produce a composite-like material.
Figure 2B:
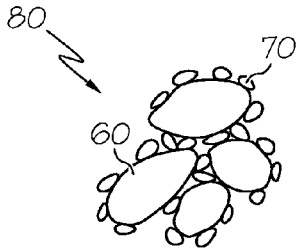
FIG. 2B is a schematic of the composite-like material of FIG. 2A after compaction.

Referring next to FIGS. 2A and 2B, the various stages of composite-like materials produced according to the present mechanical alloying process where both precursor materials are in powder form are shown. Referring with particularity to FIG. 2A, the core and surface powders 60, 70 in the right proportion are loaded into mill 10 from FIG. 1 along with the steel balls 20 or related grinding medium. The Fe—Dy-based alloy that makes up the surface powder 70 should have a smaller particle sizes than the underlying Nd—Fe—B-based core powder 60. For example, the Fe—Dy-based alloy powder 70 is preferably in the sub-micrometer to about 30 micrometer range, while the Nd—Fe—B-based powder 60 is in about the 1 to 30 micrometer range with 3 to 10 micrometers being a good average size in order to get desirable magnetic properties. This mix is then milled for the desired length of time until an even mixing and coating of surface powders 70 on core powders 60 is achieved. It is noted that the coating sometimes results in a transfer of the material of the surface powder 70 to the material of the core powder 60 while the surface powder material may still present as separate powder.

Referring with particularity to FIG. 2B, during the coating process, the mechanical milling energy and local heat may also promote the surface alloying of the core powders 60. As shown, the milled powder is then consolidated or compacted into a shape under a magnetic field (or a final part shape) 80 and sintered, as well as aged (if needed) to obtain the desired microstructure and properties. It is noted that the highly energized milled powders may help develop the microstructure of $Fe_{14}Nd_2B$ grains perfectly isolated by the nonferromagnetic phases based on Fe, Nd, Dy or Tb.

As such, important components of the mechanical alloying process include the raw materials, the mill and the process variables. Parameters include the type of mill 10, the milling container (i.e., drum 15), the milling speed (e.g., about 50 to about 400 rpm, typically about 250 rpm), the milling time (e.g., about 0.5 to about 12 hours), as well as the type, size, and size distribution (a few mm to a few centimeter in diameter) of the milling balls 20, the ball-to-powder weight ratio (e.g., about 1:1 to as high as about 220:1, with about 10:1 being typical), the extent of filling the drum 15, the milling atmosphere (e.g., vacuum, nitrogen, or argon), and the temperature of milling (e.g., about room temperature to about 250° C.). The raw materials used for mechanical alloying can have particle sizes in the range of about 1 to 200 micrometers. Using these methods, the coating thickness on the Nd—Fe—B type powder 60 can be about 1 micrometer to about 100 micrometers, for example, about 2 to about 100 micrometers, or about 3 to about 90 micrometers, or about 3 to about 80 micrometers, or about 3 to about 70 micrometers, or about 3 to about 60 micrometers. Although indicated above as not being critical, in one preferred form, the coating thickness is between about 1 micrometer and about 10 micrometers.

The powder coating process according to the present invention allows the average Dy or Tb concentration to be reduced and changes the distribution of the Dy or Tb in the magnet. As such, the average Dy or Tb bulk concentration of the magnet can be in a range of about 0.3 to about 5 weight percent, or about 0.3 to about 4 weight percent, or about 0.3 to about 3 weight percent, compared with about 6 to 10 weight percent (or more) for traditional magnets used in automotive traction motor applications having similar high magnetic properties. Meanwhile, the Dy or Tb surface concentration is as high as about 5 to about 50 weight percent in general (as mentioned above), and between about 5 and 15 weight percent in particular. Dy and/or Tb could intentionally be partially diffused into the powder particle from the particle surface if desired, so long as the bulk concentration inside the particles is less than the surface concentration. The high Dy or Tb concentration regions or phases around the Nd—Fe—B grains can be controlled by one or more of (a) the ratio of the surface powder to the core powder, (b) the Dy content in the surface powder, (c) the powder compositions, morphology and sizes, (d) the mechanical milling or coating process and (e) the sintering schedule. Significantly, it is important to maintain control of the thermodynamics and kinetics of the phase formation and phase compositions to keep the diffusion to within tightly-controlled limits; a discussion of these factors takes place above.

In a preferred form where both Dy and Tb are used, the ratio of Tb-to-Dy of up to about 1:3 can be used if desired, but a ratio of up to about 1:10 would be more typical due to cost considerations. The Dy or Tb concentration distribution feature can also be manipulated by various heat treatments of the magnets, especially annealing schedules. A longer time or higher temperature can make the Dy or Tb distribution wider and less concentrated at the particle surface.

Steps used in the wrap-around magnet manufacturing process of the present invention may include: (1) induction melting and strip casting Nd—Fe—B alloys to form thin (for example, less than 1 mm) pieces of several centimeters in size; (2) hydrogen decrepitation with the thin pieces absorb hydrogen at about 25° C. to about 300° C. for about 5 to 20 hours to break into very small pieces, followed by dehydrogenation at about 200° C. to about 400° C. for about 3 to 25 hours; (3) hammer milling and grinding and/or mechanical pulverization (in nitrogen) or nitrogen milling, if needed, to form fine powder suitable for further powder metallurgy processing; (4) optional screening for desired particle sizes to get the right particle size distribution for optimized sintering; (5) adjusting the chemical composition by mixing powders; (6) making Fe—Dy or Fe—Dy—Tb based alloy powder with other elements; (7) coating Nd—Fe—B powder with Fe—Dy-rich or Fe—Dy—Tb-rich surface powder as well as other powder without or with minimal Dy or Tb by mechanical milling; and (8) powder metallurgy steps such as weighing and pressing under a magnetic field to promote magnetic alignment of the powder in a preferred direction, isostatic pressing or shock compaction in a die, sintering at about 900° C. to about 1100° C. for about 1 to 30 hours, and aging, if needed, at about 300° C. to 700° C. for about 3 to 20 hours (in vacuum). Shock compaction or other high speed compaction techniques can also be used to make near-net shape magnets, details related to such approaches may be found in related U.S. Application 61/540,737 filed on Sep. 29, 2011 and entitled Near Net Shape Manufacturing of Rare Earth Permanent Magnets, which is assigned to the assignee of the present invention and herein incorporated by reference. Finally, the magnets may be surface treated to prevent rusting or related oxidation, if desired, examples of which include phosphate, electroless Ni plating, aluminum physical vapor deposition (PVD), epoxy coating or related means. Significantly, the wrap-around approach discussed herein can take place in either larger flake-based coating material or in smaller powder-based coating material; the important criteria is that significant surface concentration of Dy or Tb occurs while bulk values (i.e., throughout the underlying magnetic material) remain low.

Figure 3:
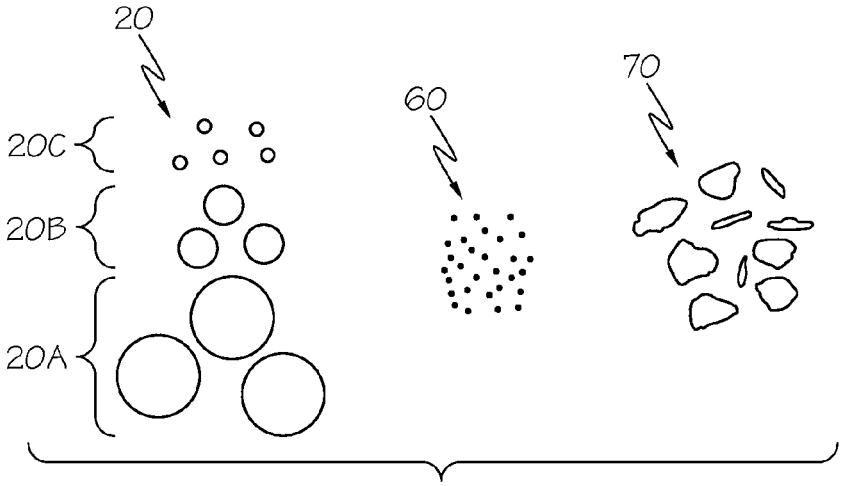
FIG. 3 depicts particles of a powder core material and flakes of a surface material, along with mixing balls of varying size that may be used in the mill of FIG. 1.

Referring next to FIG. 3, details of another embodiment of making a Nd—Fe—B sintered magnet with reduced Dy or Tb content are disclosed. In this embodiment, the resulting composite-like powder is formed by coating the relatively fine core material (corresponding for example to the Nd—Fe—B powder) 60 with a relatively coarse surface material (corresponding to the Tb- or Dy-containing flakes 70). In one form, the resulting composite-like powder 80 (such as that depicted in FIG. 2B) may include a Dy or Tb surface concentration as high as 5 to 50 weight percent, with a very low bulk Dy or Tb concentration. Specifically, the size of the coarse flakes 70 are much larger than Nd—Fe—B powder 60. For example, each linear dimension that corresponds to their surface area of the flakes 70 may be between roughly 0.5 to 15 mm, while the flake thickness may be between about 50 microns and 3 mm, whereas the fine particles making up the Nd—Fe—B powder 60 that make up the underlying or core material may be (as described above) between about 1 and 30 microns in average diameter (or diameter equivalent in the case of non-round particles) with an average of about 3 to 10 microns. Any excess coarse flakes 70 that do not adhere to the powder 60 can be subsequently screened out for future coating use after the mechanical milling.

In configurations employing the flakes 70 as the coating material, the Fe-based Dy and Tb alloy components or pieces are much softer that Nd—Fe—B powder 60; this softness of the much larger flakes promotes their efficient and effective "wraparound" structure when subjected to the dynamic energy from the numerous balls 20 during a multi-dimensional rotation and spinning motion of the ball mill 10. This wraparound action results in the formation of the composite powder 80. The average coating thickness of Dy and/or Tb-containing iron alloy from flakes 70 is preferably about 0.1 to 10 microns in general and about 0.2 to 3 microns in particular. Any lack of coating evenness or uniformity is not a concern since the coated powder is subsequently compacted to form magnets and sintered and heat treated. The latter process ensures the uniform distribution of the Dy and/or Tb-containing phases around the grain boundaries for much improved magnetic properties.

Figure 4:
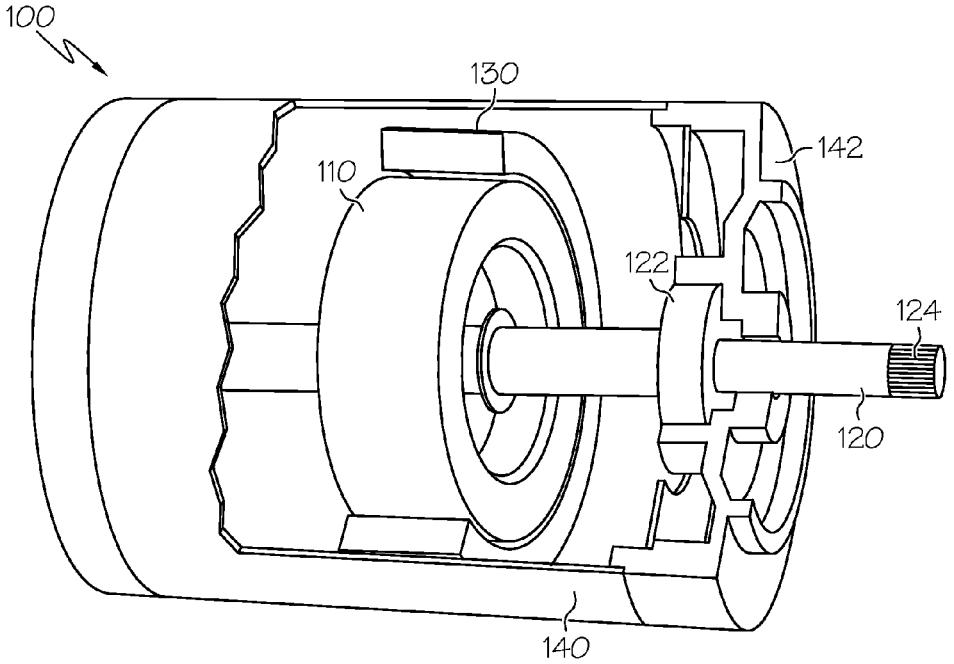
FIG. 4 shows a vehicular electric motor with magnet pieces made in conjunction with the present invention.

Referring next to FIG. 4, a simplified view of a notional permanent magnet-based electric motor 100 is shown, where a rotor 110 spins on a shaft or mandrel 120 relative to a stator 130 in response to changes in a magnetic field produced by the flow of electric current. It will be appreciated by those skilled in the art that applicability of the magnets made in accordance with the present invention are similarly applicable to other motor configurations as well, so long as they employ permanent magnet pieces (as will be discussed in more detail in conjunction with FIG. 5A). The cooperation of rotor 110 and stator 130 is such that the spinning motion of the rotor 110 can be turned into useful work along shaft or mandrel 120. For example, teeth 124 formed in the end of shaft 120 can be used to interact with a complementary surface to turn a wheel, pulley, transmission, fan or the like. A housing 140 is used to contain the rotor 110 and stator 130, while the rotatable shaft 120 may be secured to the housing 140 via one or more bearings 122 that could interact with an end plate 142 that is formed with or otherwise secured to the housing 140.

Figure 5A:
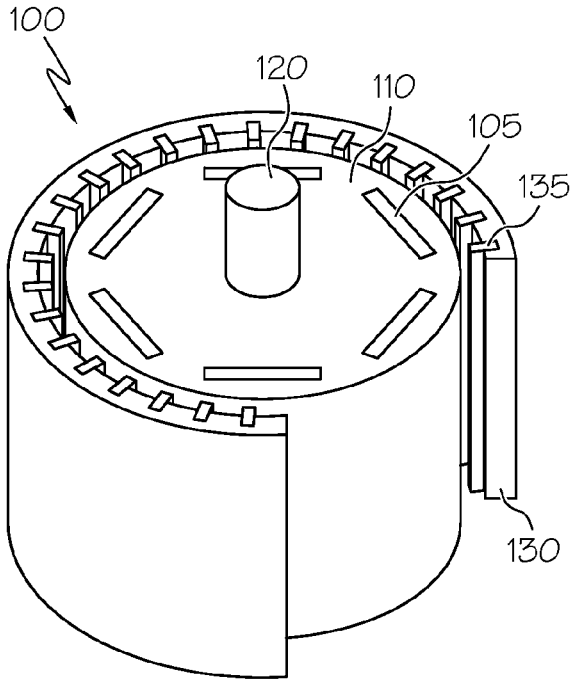
FIGS. 5A and 5B show simplified views of portions of a permanent magnet motor and an induction motor, respectively.
Figure 5B:
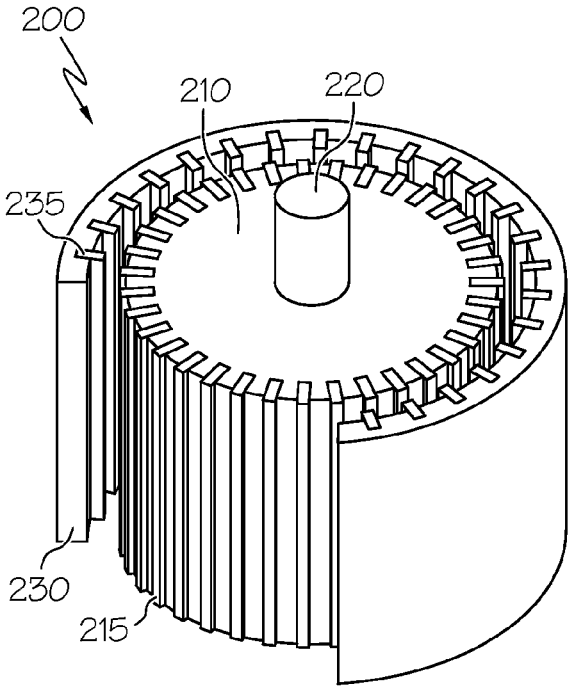

Referring next to FIGS. 5A and 5B, a comparison of a details of a variation of the notional permanent magnet motor configuration 100 from FIG. 4 and an induction motor configuration 200 highlights where in the former permanent magnets 105 of the present invention may be employed in a traction motor such as that useful for a hybrid or electrically-powered car or truck. Referring with particularity to FIG. 5B, the induction motor configuration 200 uses a rotor 210 with rotor windings 215 that cooperate with comparable windings 235 in stator 230 such that changes in current in windings 235 induce rotational movement in rotor 210 and shaft 220. Because permanent magnet motors tend to have a higher power density for the same volume as their induction motor counterparts, the former is preferred to the latter in situations where it is important to generate large amounts of power in s small volume package, such as those involving compact propulsion sources for vehicular applications. As such, the latter configuration associated with induction motors will not be discussed in any additional detail.

Referring with particularity to FIG. 5A, either or both of the rotor 110 and a stator 130 of the permanent magnet-based electric motor 100 may be configured to hold one or more permanent magnets 105 made in conjunction with the present invention (although the simplified view of FIG. 5A only shows them in the rotor 110). These magnets 105 cooperate with windings 135 formed in stator 130 such that changes in electrical current flow in windings 135 induce changes in the magnetic field surrounding magnets 105 that in turn force rotational movement in rotor 110 and shaft 120 such that useful work may be produced. Such a motor 100 may be used to form either the sole means of propulsion for an electric vehicle, or may form part of propulsion system for a hybrid vehicle, or may be used as part of an electrically variable transmission that can continuously vary the speed of the vehicle's engine or work in conjunction with regenerative braking.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "device" is utilized herein to represent a combination of components and individual components, regardless of whether the components are combined with other components. Likewise, a vehicle as understood in the present context includes numerous self-propelled variants, including a car, truck, aircraft, spacecraft, watercraft or motorcycle.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A method of making a permanent magnet with an inhomogeneous dispersion of at least one of dysprosium or terbium thereon, said method comprising:

providing a first material containing neodymium, iron and boron, wherein the average particle size of said first material is between 3 micrometers and 10 micrometers;

providing a second material containing iron and at least one of dysprosium and terbium, said at least one of dysprosium and terbium in a metallic alloy form, wherein the second material is dehydrided;

combining said first and dehydrided second materials in a mechanical mill such that said first material is substantially coated with a layer of said second material;

forming the first and second materials into a predetermined shape; and sintering said predetermined shape such that said permanent magnet is formed with a non-uniform distribution of said second material on a surface of said first material.

2. The method of claim 1, wherein said second material forms predominantly along grain boundaries within said first material.

3. The method of claim 2, wherein said first material is powder-based and said second material is flake-based such that said second material wraps around said first material by the operation of said mechanical mill.

4. The method of claim 3, further comprising screening out an excess portion of said flake-based material that does not form said coating.

5. The method of claim 3, wherein said first material has a higher hardness number than said second material prior to said combining.

6. The method of claim 1, wherein said first and second materials are powder-based.

7. The method of claim 6, wherein said second material is in a finer form than said first material prior to being subjected to the operation of said mechanical mill.

8. The method of claim 1, wherein said combining said first and second materials in a mechanical mill comprises using a mixture of elemental and master alloy powders.

9. The method of claim 1, wherein said combining comprises plastically deforming at least one of said first and second materials.

10. The method of claim 1, wherein said permanent magnet has a grain boundary surface concentration of between about 3 weight percent and about 40 weight percent of said at least one of dysprosium or terbium.

11. The method of claim 1, wherein said forming the first and second materials into a predetermined shape takes place in a magnetic field.

12. The method of claim 1, wherein said sintering takes place at a temperature range of between about 850° C. and 1100° C. with a heating rate of between about 2° C. and 6° C. per minute and a sintering time of about 1 to 10 hours.

13. A method of making a neodymium-based permanent magnet with an inhomogeneous dispersion of at least one of dysprosium or terbium, said method comprising:

mechanically milling a powder-based material containing neodymium, iron and boron and a flake-based material containing iron and at least one of dysprosium and terbium such that said powder-based material is substantially coated with a layer of said flake-based material, wherein the average particle size of said powder-based material is between 3 micrometers and 10 micrometers, wherein the flake-based material is dehydrided;

screening out an excess of said dehydrided flake-based material from said coated powder-based material;

forming the powder-based material and dehydrided flake-based material into a predetermined shape; and sintering said predetermined shape such that said permanent magnet is formed where said flake-based material is distributed in a non-uniform way on a surface of said powder-based material.

14. The method of claim 13, wherein said flake-based material defines a larger surface area than said powder-based material prior to said mechanical milling.

15. The method of claim 14, wherein said flake-based material has linear dimensions larger than the average diameter of said powder-based material.

16. A method of making a neodymium-based permanent magnet with an inhomogeneous dispersion of at least one of dysprosium or terbium, said method comprising:

mechanically milling a first powder-based material containing neodymium, iron and boron and a second powder-based material containing iron and at least one of dysprosium and terbium such that said first powder-based material is substantially coated with a layer of said second powder-based material, wherein the average particle size of said first powder-based material is between 3 micrometers and 10 micrometers, wherein the second powder-based material is dehydrided;

forming the first and dehydrided second materials into a predetermined shape; and sintering said predetermined shape such that said permanent magnet is formed where said second powder-based material is distributed in a non-uniform way on a surface of said first powder-based material.

17. The method of claim 16, wherein particles making up said first powder-based material are larger than particle making up said second powder-based material.

18. The method of claim 16, wherein said mechanical milling comprises using a plurality of mixing balls placed within the mill such that said plurality of mixing balls define a plurality of different sizes.

19. The method of claim 18, further comprising controlling a temperature of said mechanical milling through the placement of a heat exchange fluid in thermal communication with at least one of a housing of the mill and said plurality of mixing balls.

* * * * *